US010385568B2

(12) United States Patent
Keene et al.

(10) Patent No.: US 10,385,568 B2
(45) Date of Patent: Aug. 20, 2019

(54) CLIP FOR ACOUSTICAL WALL OR CEILING MOUNT

(71) Applicant: Keene Building Products Co., Inc., Mayfield Heights, OH (US)

(72) Inventors: James R. Keene, Pepper Pike, OH (US); Daniel Gibson, Mayfield Heights, OH (US)

(73) Assignee: Keene Building Products Co., Inc., Cleveland, OH (US)

( * ) Notice: Subject to any disclaimer, the term of this patent is extended or adjusted under 35 U.S.C. 154(b) by 0 days.

(21) Appl. No.: 15/865,577

(22) Filed: Jan. 9, 2018

(65) Prior Publication Data

US 2019/0211554 A1 Jul. 11, 2019

(51) Int. Cl.

| | |
|---|---|
| ***F16M 11/00*** | (2006.01) |
| ***E04B 9/24*** | (2006.01) |
| ***E04F 15/20*** | (2006.01) |
| ***E04B 9/00*** | (2006.01) |
| ***E04B 1/84*** | (2006.01) |

(52) U.S. Cl.
CPC ..... *E04B 9/242* (2013.01); *E04B 1/8409* (2013.01); *E04B 9/001* (2013.01); *E04F 15/20* (2013.01)

(58) Field of Classification Search
CPC ..... E04B 2/30; E04B 1/70; E04C 2/34
See application file for complete search history.

(56) References Cited

U.S. PATENT DOCUMENTS

| | | | | |
|---|---|---|---|---|
| 7,093,814 | B2 | 8/2006 | Meisel et al. | |
| 7,895,803 | B2 | 3/2011 | Downey et al. | |
| 8,136,320 | B2 | 3/2012 | Keene | |
| 9,045,898 | B2 | 6/2015 | Ravnaas | |
| 9,121,469 | B2 | 9/2015 | Downey et al. | |
| 9,388,572 | B2 | 7/2016 | Gates et al. | |
| 9,481,999 | B2 | 11/2016 | Geller | |
| 2008/0086966 | A1* | 4/2008 | Stevens | E04B 1/84 52/347 |
| 2008/0202846 | A1 | 8/2008 | Gernhart | |
| 2010/0229484 | A1* | 9/2010 | Carolan | E04C 2/292 52/302.1 |
| 2010/0263321 | A1 | 10/2010 | Stevens et al. | |

* cited by examiner

*Primary Examiner* — Amy J. Sterling
(74) *Attorney, Agent, or Firm* — Renner, Otto, Boisselle & Sklar, LLP

(57) ABSTRACT

The present disclosure provides a clip for securing a support channel in an acoustical ceiling mount and a building construction having a wall, flooring, or ceiling assembly that displays improved acoustic characteristics. The clip includes a body having a penetration-resistant base, a channel interface extending outwardly from a portion of the base configured to engage the support channel, and an opening in another portion of the base, a grommet engaged in the opening of the body, and an insert engaged in the grommet. The channel interface includes at least a first slot configured to receive a channel fastener to secure the support channel to the clip. The clip may be operatively coupled with a support channel and disposed in a building construction between the support channel and a finished interior element.

10 Claims, 9 Drawing Sheets

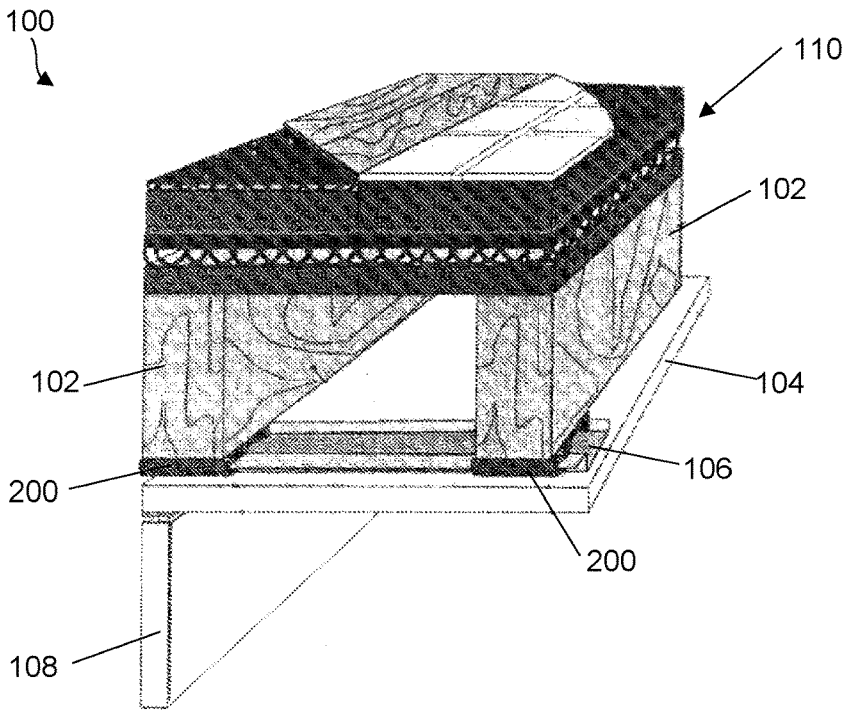
FIG. 1
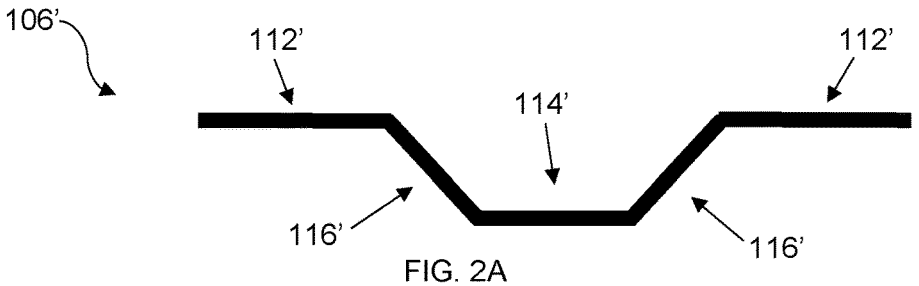
FIG. 2A
- CONVENTIONAL ART
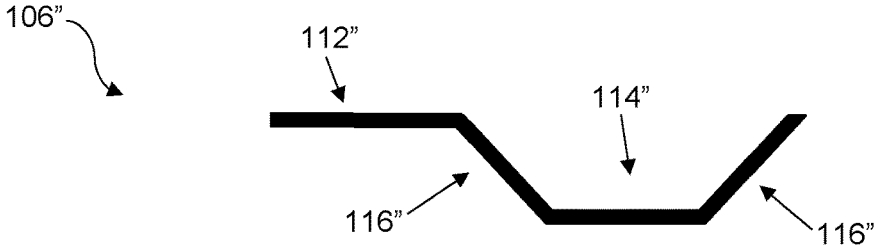
FIG. 2B - CONVENTIONAL ART

CLIP FOR ACOUSTICAL WALL OR CEILING MOUNT

TECHNICAL FIELD

The present disclosure relates to building constructions and acoustic control therein, and more particularly to a clip adapted to prevent an acoustic short circuit in a building ceiling, floor, or wall assembly and to better secure a support channel thereto.

BACKGROUND

Acoustic short circuits are a commonly-encountered problem in buildings resulting from sub-standard construction practices. Short circuiting refers to the situation where building structural elements become linked, often through a fastener (e.g., a screw), in such a manner that vibrational energy, particularly sound energy, affecting one of the structural elements is transmitted to the linked structure. The effects of acoustic short circuiting are extremely noticeable and objectionable in multi-unit buildings, such as condominiums, apartment buildings, and the like where people are present near each other or near electrical or mechanical equipment.

SUMMARY

The present disclosure provides a clip for securing a support channel in an acoustical wall or ceiling mount and a building construction having a wall, flooring, or ceiling assembly that displays improved acoustic characteristics. The clip includes a body having a penetration-resistant base, a channel interface extending outwardly from a portion of the base configured to engage the support channel, and an opening in another portion of the base, a grommet engaged in the opening of the body, and an insert engaged in the grommet. The support channel interface includes at least a first slot configured to receive a channel fastener to secure the support channel to the clip. The clip may be operatively coupled with a support channel and disposed in a building construction between the support channel and a finished interior element.

In accordance with one aspect of the present disclosure, a clip for securing a support channel in an acoustical wall or ceiling mount includes a body having a penetration-resistant base, a channel interface extending outwardly from a portion of the base and configured to engage the support channel, and an opening in another portion of the base, the channel interface including at least a first slot configured to receive a channel fastener to secure the support channel to the clip; a grommet engaged in the opening of the body; and an insert engaged in the grommet.

In one embodiment, the channel interface includes a lip having a J-shaped configuration, a planar portion of the lip extending orthogonally away from the base, and a curved portion of the lip extending back toward the base.

In another embodiment, the channel interface includes a flare extending away from the lip and away from the base such that the lip and flare are configured to underlie the support channel disposed in the channel interface.

In another embodiment, the channel interface includes a projection extending away from the base along a plane parallel to the flare and configured to apply pressure to the support channel.

In another embodiment, the channel interface includes a first leg extending orthogonally away from the base opposite the lip, an engaging portion extending orthogonally away from the first leg toward the lip along a plane parallel to the base, and a second leg extending orthogonally away from the engaging portion towards the base along a plane parallel to the first leg.

In another embodiment, the engaging portion includes a projection extending away from the engaging portion in a direction opposite the base along a plane parallel to the flare and configured to apply pressure to the support channel.

In another embodiment, the channel interface includes the first slot defined by an opening through the lip and flare and further includes a second slot defined by an opening through the engaging portion, the first and second slots being configured to receive the channel fastener to secure the support channel between the lip and flare and engaging portion.

In another embodiment, a cavity is defined by the base, the first leg, the engaging portion, and the second leg, the channel fastener received by the first and second slots continues into the cavity, and the base is configured to prevent the channel fastener from penetrating therethrough.

In another embodiment, the grommet includes a joist contact portion on a side of the base opposite the channel interface configured to physically decouple the clip and the support channel from an adjacent joist.

In another embodiment, the grommet and insert are configured to receive a structural member fastener to secure the clip to an adjacent joist.

In another embodiment, an assembly for preventing acoustic short circuiting in a building construction includes the clip of the present disclosure and a support channel engaged therewith.

In accordance with another aspect of the present disclosure, a building construction having a wall, flooring, or ceiling assembly that displays improved acoustic characteristics includes at least one structural beam; at least one finished interior element; at least one support channel disposed between the finished interior element and the structural beam, the support channel including a flange and extending lengthwise in a direction perpendicular to the length of the structural beam; and a clip operatively coupled with the support channel and disposed at least partially between the support channel and the finished interior element, wherein the clip includes: a body having a penetration-resistant base, a channel interface extending outwardly from a portion of the base and having engaging means engaging the flange of the support channel, and an opening in another portion of the base, the engaging means including at least a first slot configured to receive a channel fastener for fastening the support channel to the clip; a grommet engaged in the opening of the body, the grommet having a joist contact portion on a side of the base opposite the channel interface and positioned against the structural beam; and an insert engaged in the grommet configured to receive a structural member fastener to secure the clip to the structural beam, wherein the structural beam is one or more of a horizontal structural beam and a vertical structural beam, and wherein the finished interior element is one or more of an interior finished ceiling element and an interior finished wall element.

In one embodiment, the support channel is an elongate resilient support adapted for maintaining a separation between the structural beam and the finished interior element, wherein the interior element is gypsum wall board, and wherein the structural beam is constructed of one of lumber or metal framing.

In another embodiment, the engaging means further include a lip having a J-shaped configuration, a planar portion of the lip extending orthogonally away from the base, and a curved portion of the lip extending back toward the base.

In another embodiment, the engaging means further include a flare extending away from the lip and away from the base such that the lip and flare are configured to underlie the support channel disposed in the channel interface In another embodiment, the engaging means further include a projection extending away from the base along a plane parallel to the flare and configured to apply pressure to the support channel.

In another embodiment, the channel interface includes a first leg extending orthogonally away from the base opposite the lip, an engaging portion extending orthogonally away from the first leg toward the lip along a plane parallel to the base, and a second leg extending orthogonally away from the engaging portion towards the base along a plane parallel to the first leg.

In another embodiment, the channel interface includes the first slot defined by an opening through the lip and flare and further includes a second slot defined by an opening through the engaging portion, the first and second slots being configured to receive the channel fastener to secure the support channel between the lip and flare and the engaging portion.

In another embodiment, the clip body is constructed of steel.

In another embodiment, the assembly further includes a finished flooring element overlying the at least one structural beam, the finished flooring element having a base, a compressible layer overlying at least a portion of the base, a mat layer of an open network of entangled fibers overlying at least a portion of the compressible layer, a porous separation layer overlying at least a portion of the mat layer, and a substrate layer overlying at least a portion of the portion separation layer.

BRIEF DESCRIPTION OF THE DRAWINGS

FIG. 1 is a perspective and partially cut away view of an example flooring assembly incorporating a pair of exemplary clips according to the present disclosure.

FIG. 2A is a cross sectional view of a support channel to which the clip of the present disclosure may be secured.

FIG. 2B is a cross sectional view of an alternate example support channel to which the clip of the present disclosure may be secured.

DETAILED DESCRIPTION

Figure 3A:
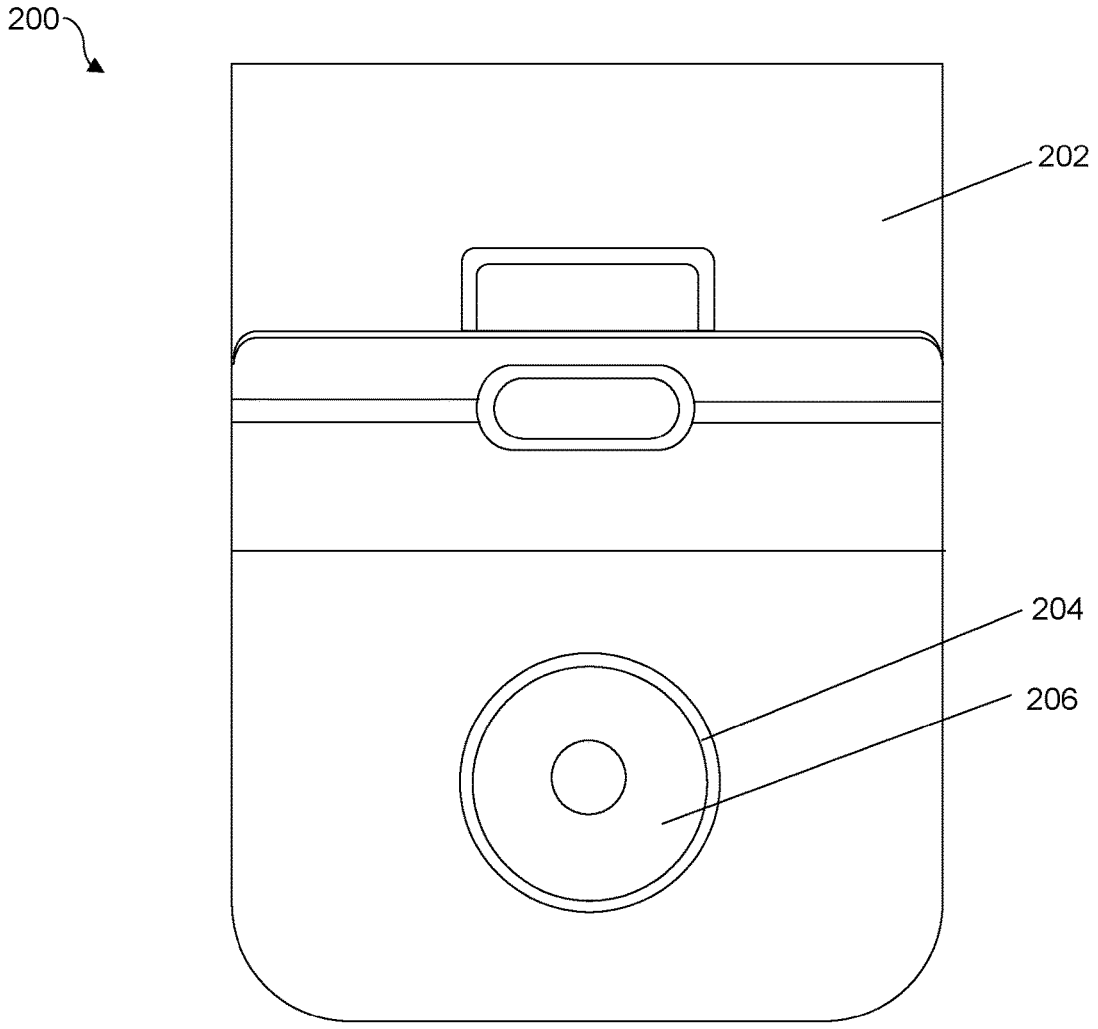
FIG. 3A is a bottom view of an exemplary clip according to the present disclosure.

In the description that follows, like components have been given the same reference numerals, regardless of whether they are shown in different embodiments. To illustrate an embodiment(s) of the present disclosure in a clear and concise manner, the drawings may not necessarily be to scale and certain features may be shown in somewhat schematic form. Features that are described and/or illustrated with respect to one embodiment may be used in the same way or in a similar way in one or more other embodiments and/or in combination with or instead of the features of the other embodiments.

All numerical ranges disclosed in the specification and claims may be combined in any manner. It is to be understood that unless specifically stated otherwise, references to "a," "an," and/or "the" may include one or more than one, and that reference to an item in the singular may also include the item in the plural. All combinations specified in the claims may be combined in any manner.

The present disclosure provides a clip for securing a support channel in an acoustical wall or ceiling mount and a building construction having a wall, flooring, or ceiling assembly that displays improved acoustic characteristics. In contrast with conventional clips that rely on friction to secure a support channel to the clip, the clip of the present disclosure provides a means for fastening a support channel to the clip. An exemplary clip includes a body, a grommet, and an insert. The body has a penetration-resistant base, a channel interface extending outwardly from a portion of the base and configured to engage the support channel, and an opening in another portion of the base. The channel interface may include several bends, including 90-degree angles, that form a cavity, a first slot, and a second slot configured to receive a channel fastener to secure the support channel to the clip. The channel interface also includes a friction point in the form of a lip, a flare, and a projection to hold the clip in place while the support channel is being secured to the clip with the channel fastener. The grommet is engaged in the opening of the body. The insert is engaged in the grommet. The clip may be operatively coupled with a support channel and disposed in a building construction between the support channel and a finished interior element. The grommet of the clip is positioned against a structural beam to physically decouple the body of the clip and the support channel from the structural beam, resulting in reduced vibration and isolation dampening. A channel fastener is inserted through the first slot of the clip and the support channel to secure the support channel to the clip. The channel fastener continues through the second slot of the clip and is prevented from extending through the structural member by the base. A structural member fastener is inserted through the insert and grommet and into a structural beam to secure the clip to the structural member.

Referring now in detail to the drawings, and initially to FIG. 1, illustrated is an example of a flooring assembly 100 for which the clip 200 of the present disclosure is intended for use. The flooring assembly 100 generally consists of a plurality of structural supports or joists 102, a horizontal ceiling or wall member 104, one or more supporting elements 106, and a vertical wall element 108. The joists 102 are primary structural members with which other flooring and building elements are associated, and are typically elongate rectangular wooden beams disposed horizontally between vertical supporting wall members, and spaced apart and parallel to each other.

The joists 102 provide an intermediate structural member for supporting finished interior elements both above and below, i.e., a floor above and a ceiling below. In a multi-story construction, the joists 102 typically provide an intermediate structure between the ceiling of a first unit and/or room and the floor of a second unit and/or room disposed one story above the first unit. As can be seen, the joists 102 provide a substrate onto which finished flooring elements 110 are installed. Such finished flooring elements 110 may include such items as wood or similar suitable flooring materials, sound control materials, subfloor items, carpeting, tile, aesthetic elements, and the like.

The joists 102 provide a substrate for installation of various ceiling elements to bottom portions thereof. As shown, the joists 102 provide support for ceiling elements such as sheets of gypsum board 104 along a bottom portion thereof. As is known, the gypsum board may in turn feature aesthetic elements and/or be modified to complete and customize the appearance of the ceiling.

Conventional installation of gypsum board to the bottom of structural joists typically includes use of one or more elongate sheet metal, usually steel, support elements 106 having generally U-shaped channels therein. In the construction trades, the support elements 106 are commonly called "support channels" and will be referred to as "support channels" hereinafter. The support channels 106 are disposed between the ceiling element 104 and perpendicular to the joists 102. The support channels 106 are intended to improve the acoustic properties of flooring assemblies 100 by physically separating and acoustically decoupling the finished ceiling, i.e., the gypsum board 104, from the joists 102. By decoupling the gypsum board from the joists, the likelihood of creating an acoustic short circuit therebetween is reduced. However, as mentioned above, unintended installation errors frustrate the intent of using support channels 106 when fasteners are driven completely through the channels 106 and into the joists 102. Fasteners passing through the support channels into the joists creates an acoustic short circuit that is prevented by the present disclosure.

Support channels, such as a furring channel, are typically provided in one of two configurations, a hat channel and a resilient channel. With reference to FIG. 2A, a hat channel 106' is an elongate sheet metal or polymeric member adapted to be secured to bottom portions of the joists 102 (FIG. 1) and the gypsum board 104 (FIG. 1) is fastened thereto. The hat cannel 106' includes a pair of flanges 112', a gypsum board fastening portion 114', and a pair of angular arms 116'. The gypsum board fastening portion 114' is preferably a planar portion defining a middle, lower portion of the hat channel 106'. The arms 116' extend angularly upward at an approximately 45 degree angle and away from opposite edges of the fastening portion 114'. The flanges 112', in turn, extend away from edges of the angular arm 116' and are substantially parallel to the fastening portion 114'. Because of the presence of the angular arms 116', the flanges 112' are disposed vertically offset and/or raised relative to the fastening portion 114'.

During conventional installation of the hat channel 106', the hat channel 106' is typically secured directly to bottom portions of the joists 102 (FIG. 1) with threaded fasteners, and then the gypsum board 104 (FIG. 1) is fastened to the hat channel 106'. More specifically, upper faces of the flanges 112' are positioned flush against bottom portions of the joists 102 and fasteners are passed through the flanges 112' and into the joists 102 to secure the hat channel 106' to the joists 102. In this configuration, the fastening portion 114' is spaced apart from the joist 102. Accordingly, the gypsum board 104 is then positioned horizontally and flush against the hat channel 106' fastening portion 114', and fasteners are driven through the gypsum board 104 and into the fastening portion 114', thereby securing the gypsum board 104 to the hat channel 106' and, in turn, to the joist 102.

Referring to FIG. 2B, an alternate channel referred to as a resilient channel is shown at 106". The resilient channel 106" differs from a hat channel 106' in that the resilient channel 106" features a single flange 112" as opposed to the hat channel 106' that features a pair of flanges 112'. In installation, the flange 112" of the resilient channel 106" is brought flush against a joist bottom portion and then a fastener is passed through the flange 212" into the joist 102 (FIG. 1), thereby securing the resilient channel 106" to the joist 102. Thereafter, the gypsum board 104 (FIG. 1) is brought against the fastening portion 114" and fastened thereto. The installation of the resilient channel 106" results in an angular arm 116" remaining free and unfastened, thus resulting in the resiliency provided by the resilient channel 106".

Figure 3B:
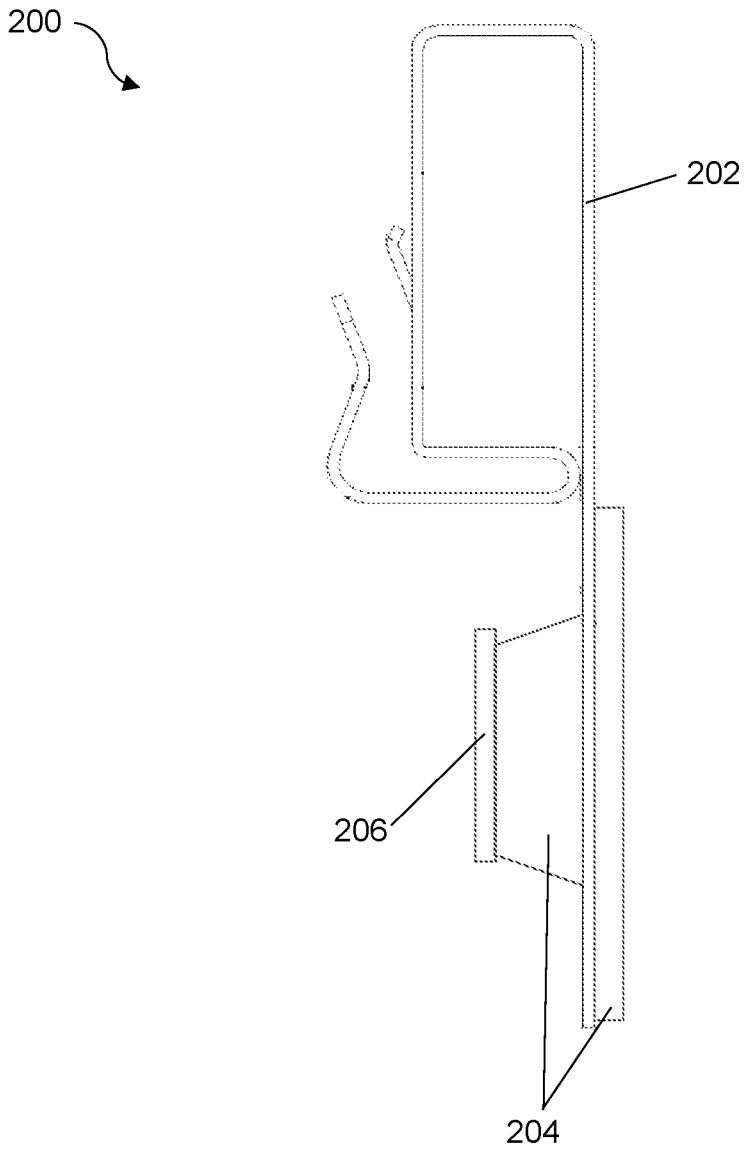
FIG. 3B is a side view of the clip of FIG. 3A.

Referring to FIGS. 3A and 3B, an exemplary clip is shown at 200. The clip is a generally rectangular member adapted to be positioned between the joist 102 (FIG. 1) and the support channel 106 (FIG. 1). The clip includes a body 202, a grommet 204, and an insert 206.

Figure 4A:
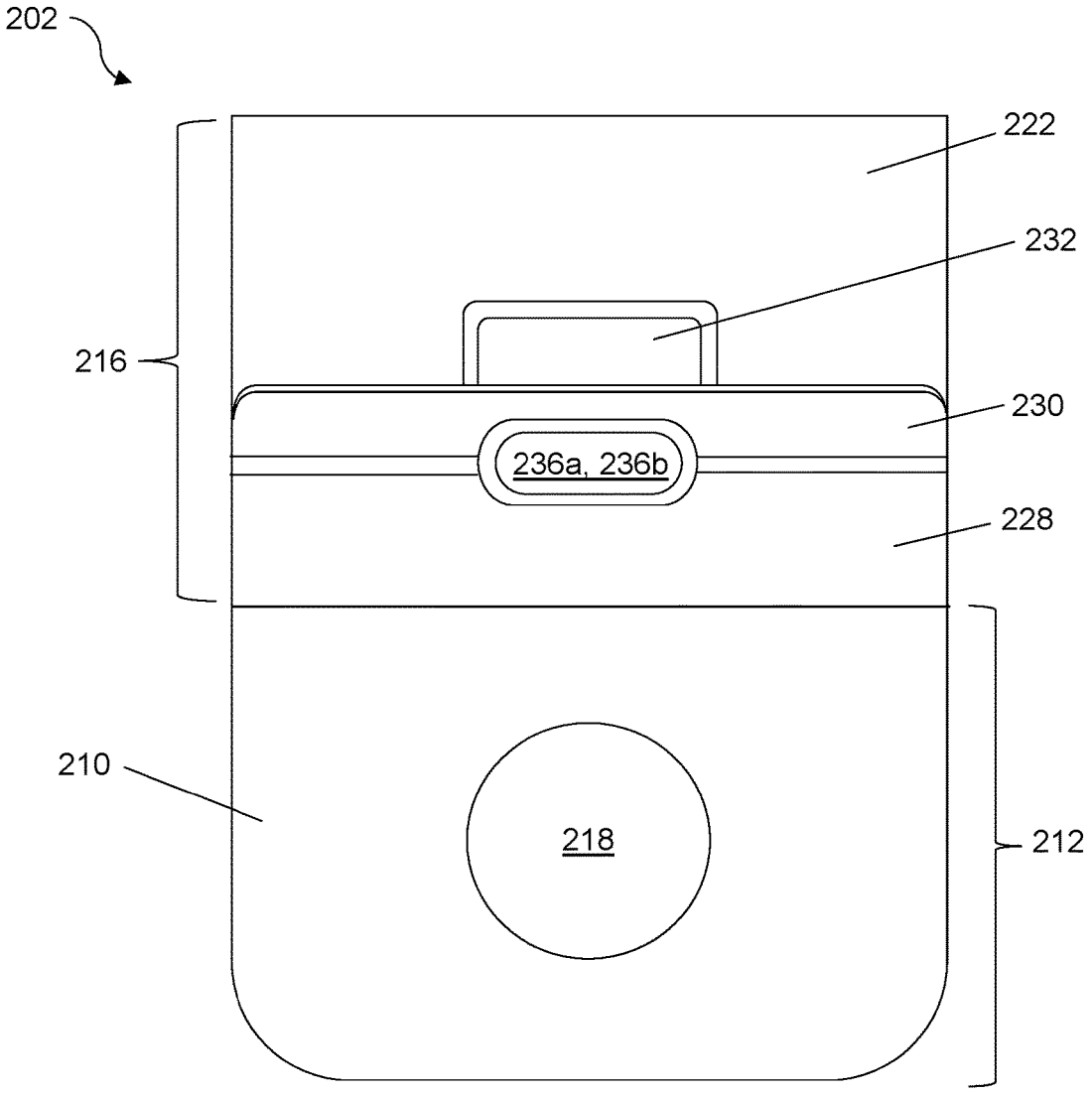
FIG. 4A is a bottom view of the body of the clip of FIG. 3A.
Figure 4B:
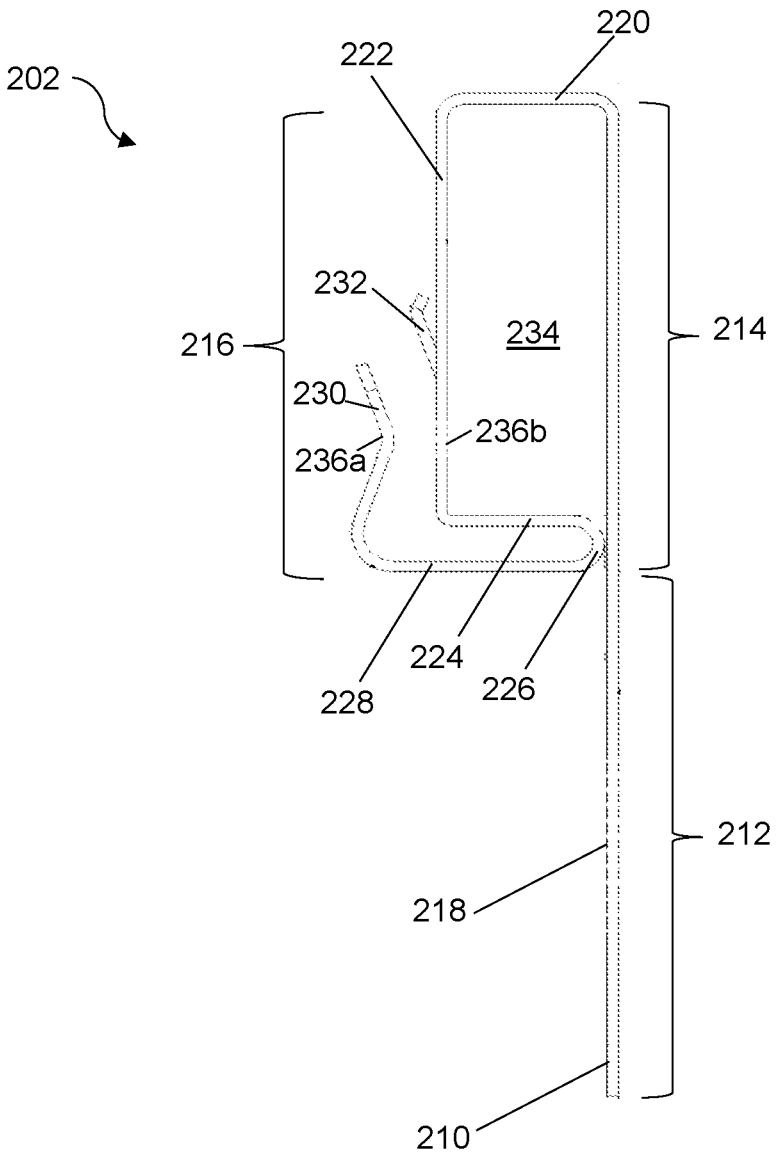
FIG. 4B is a cross sectional view of the body of the clip of FIG. 3A.

Referring to FIGS. 4A and 4B, an exemplary body is shown at 202. The body 202 is a generally rectangular member. The body 202 may have a length in the range of about 25 mm to about 100 mm, or in another example, in the range of about 50 mm to about 75 mm, or in another example, in the range of about 65 mm to about 75 mm.

In a preferred embodiment, the body 202 has a length of about 70 mm. The body 202 may have a width in the range of about 25 mm to about 100 mm, or in another example, in the range of about 25 mm to about 75 mm, or in another example, in the range of about 45 mm to about 65 mm, or in another example, in the range of about 45 mm to about 50 mm. In a preferred embodiment, the body 202 has a width of about 50 mm.

The body 202 may be made of a single piece of material. The material of the body 202 may have a generally uniform thickness throughout. The body 202 may have a thickness in the range of about 0.25 mm to about 2 mm, or in another example, in the range of about 0.5 mm to about 1.5 mm, or in another example, in the range of about 0.5 mm to about 1 mm. In a preferred embodiment, the material of the body 202 has a thickness of about 0.8 mm.

The body 202 may be made from a material, for example steel, that resists and prevents penetration by a conventional wall board fastener such as nail or a dry wall screw. For example, the body 202 may be made of cabon steel, alloy steel, stainless steel, tool steel, or a mixture of two or more thereof. The steel may be any grade to allow for the stamping and hardening of the steel into the body 202. The use of steel is also advantageous in connection with permitting the body 202 to pass a burn test as required by the building construction codes. However, it is to be appreciated that any suitable material may be employed in the construction of the body 202, such as a polymeric material, a polymeric material featuring a flame-resistant additive, a suitable metal, a composite material, and the like provided that the penetration resistance is achieved to prevent penetration of fasteners into the joists during installation of the support channel.

The body 202 includes a base 210 having a joist portion 212, a channel portion 214, and a channel interface 216. The joist portion 212 is a substantially planar member that extends along a plane and terminates in the channel portion 214. The joist portion 212 may have a length in the range of about 25 mm to about 50 mm, or in another example, in the range of about 35 mm to about 45 mm. In a preferred embodiment, the joist portion 212 has a length of about 38 mm. The joist portion 212 extends the width of the body 202. The joist portion 212 includes an opening 218 to receive and engage the grommet 204. The opening 218 may be generally centrally located on the joist portion 212. The opening 218 is generally circular and has a diameter in the range of about 10 mm to about 30 mm, or in another example, in the range of about 15 mm to about 25 mm. In a preferred embodiment, the opening 218 has a diameter of about 19 mm.

The channel portion 214 is a substantially planar member that is continuous with and shares a common surface with the joist portion 212. The channel portion 214 extends away from the joist portion 212 and terminates in the channel interface 216. The channel portion 214 may have a length in the range of about 25 mm to about 50 mm, or in another example, in the range of about 30 mm to about 40 mm. In a preferred embodiment, the channel portion 214 has a length of about 35 mm. The channel portion 214 extends the width of the body 202.

The channel interface 216 includes a first leg 220, an engaging portion 222, a second leg 224, a transition portion 226, a lip 228, and a flare 230. The first leg 220 is a substantially planar surface positioned opposite the joist portion 212. The first leg 220 is continuous with and extends orthogonally away from the channel portion 214 of the base 210 with an initial curvature between the channel portion 214 and the first leg 220. The first leg 220 terminates in the engaging portion 222. The first leg 220 may have a length in the range of about 5 mm to about 25 mm, or in another example, in the range of about 10 mm to about 15 mm. In a preferred embodiment, the first leg 220 has a length of about 13 mm. The first leg 220 extends the width of the body 202.

The engaging portion 222 is a substantially planar surface that is continuous with and extends orthogonally away from the first leg 220 towards the joist portion 212 of the base 210 with an initial curvature between the first leg 220 and the engaging portion 222. The engaging portion 222 is disposed along a plane that is generally parallel to the base 210. The engaging portion 222 may have a length in the range of about 10 mm to about 50 mm, or in another example, in the range of about 20 mm to about 40 mm, or in another example, in the range of about 25 mm to about 35 mm. In a preferred embodiment, the engaging portion 222 has a length of about 30 mm. The engaging portion 222 extends the width of the body 222.

The engaging portion 222 includes a projection 232 that extends away from the engaging portion 222 in a direction opposite the base 210. The projection 232 is generally configured to apply pressure to the angular arm 116 of the support channel 106, thereby decreasing the likelihood that the support channel 106 (FIG. 1) may inadvertently come dissociated from the clip 200. The projection 232 may extend a distance away from the engaging portion 222 in the range of about 0.5 mm to about 5 mm, or in another example, in the range of about 1 mm to about 3 mm, or in another example, in the range of about 1 mm to about 2 mm. In a preferred embodiment, the projection 232 extends a distance away from the engaging portion of about 1.8 mm.

The engaging portion 222 terminates in the second leg 224. The second leg 224 is a substantially planar surface positioned opposite the first leg 220. The second leg 224 is continuous with and extends orthogonally away from the engaging portion 222 towards the base 210 with an initial curvature between the engaging portion 222 and the second leg 224. The second leg 224 is disposed along a plane that is generally parallel to the first leg 220. The second leg 224 may have a length in the range of about 5 mm to about 25 mm, or in another example, in the range of about 10 mm to about 15 mm. In a preferred embodiment, the second leg 224 has a length of about 13 mm. The second leg 224 extends the width of the body 202. The second leg 224 may have substantially the same length as the first leg 220. The channel portion 214 of the base 210, the first leg 220, the engaging portion 222, and the second leg 224 define a cavity 234.

The second leg 224 terminates in the transition portion 226. The transition portion 226 has a substantially U-shaped that is continuous with an extends orthogonally away from the second leg 224 toward the joist portion 212 of the base 210 with an initial curvature between the second leg 224 and the transition portion 226. The transition portion 226 is disposed along a plane that is generally parallel to the base 210. The transition portion 226 contacts the channel portion 214 of the base 210. The transition portion 226 terminates in the lip 228. The transition portion 226 may have a length in the range of about 1 mm to about 10 mm, or in another example, in the range of about 3 mm to about 7 mm, or in another example, in the range of about 4 mm to about 6 mm. In a preferred embodiment, the transition portion 226 has a length of about 5 mm. The transition portion 226 extends the width of the body 202.

The lip 228 is characterized by the letter "J" configuration. A substantially planar portion of the lip 228 (i.e., the straight part of the "J") extends orthogonally from the transition portion 226 away from the base 210. The lip 228 is positioned on the same side of the base 210 as the first leg 220, engaging portion 222, and second leg 224. The substantially planar portion of the lip 228 is disposed along a plane that is generally parallel to the first leg 220 and the second leg 224. The substantially planar portion of the lip 228 may have a length in the range of about 5 mm to about 30 mm, or in another example, in the range of about 10 mm to about 20 mm, or in another example, in the range of about 15 mm to about 20 mm. The lip 228 has a substantially curved portion (i.e., the curve of the "J") that downwardly extends back toward the engaging portion 222 such that the lip 228 is a distance away from the engaging portion 222 of about 1 mm to about 5 mm, or in another example, in the range of about 2 mm to 4. In a preferred embodiment, the curved portion of the lip 228 is a distance away from the engaging portion 222 of about 3 mm. The lip 228 terminates in the flare 230.

The flare 230 is a substantially planar surface that is continuous with and extends away from the lip 228 toward the first leg 220 along a plane parallel to the projection 232 with a slight initial curvature between the lip 228 and the flare 330. The lip 228 and the flare 230 provide a feature that is adapted to underlie the flange 112 of the support channel 106 (FIG. 1) disposed in the channel interface 216, and also provides a funnel-like effect to facilitate the insertion of the flange of the support channel 106 into the channel interface 216.

A first slot 236*a* is defined by an opening through the lip 228 and flare 230 and a second slot 236*b* is defined by an opening through the engaging portion 222. The slots 236*a* and 236*b* are disposed along a plane generally parallel to the base. The slots 236*a* and 236*b* have a generally oval shape, but may have any circular shape to accommodate a channel fastener. The slots 236*a* and 236*b* provide a feature that is adapted to receive a fastener to secure the support channel 106 (FIG. 1) to the clip 200. Securing the support channel via a channel fastener as opposed to friction is preferred. The channel fastener received in the slots 236*a* and 236*b* continues into the cavity 234, but is prevented from penetrating the adjacent joist 202 (FIG. 1) due to the penetration-resistant base 210. The slots 236*a* and 236*b* are preferable to a hole because the slots 236*a* and 236*b* can accommodate a wide variety of different fasteners and do not strip the fastener during temperature changes. The slots 236*a* and 236*b* may have a length in the range of about 2 mm to about 20 mm, or in another example, in the range of about 5 mm to about 15 mm, or in another example, in the range of about 5 mm to about to 100 mm. The slots 236*a* and 236*b* may have a width in the range of about 1 mm to about 10 mm, or in another example, in the range of about 2 mm to about 7 mm, or in another example, in the range of about 3 mm to about 6 mm.

Figure 5A:
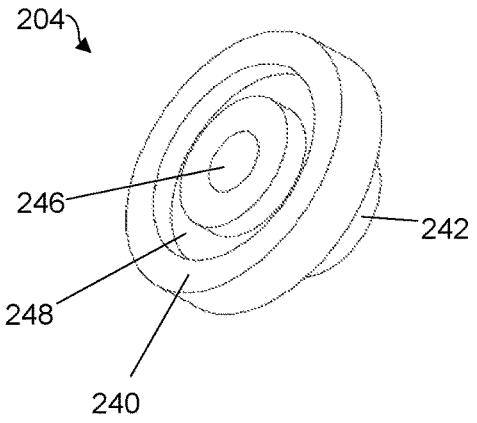
FIG. 5A is a perspective view of the grommet of the clip of FIG. 3A.
Figure 5B:
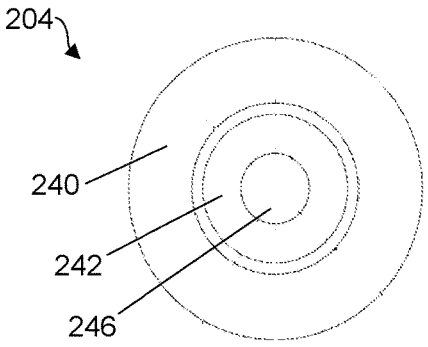
FIG. 5B is a bottom view of the grommet of the clip of FIG. 3A.
Figure 5C:
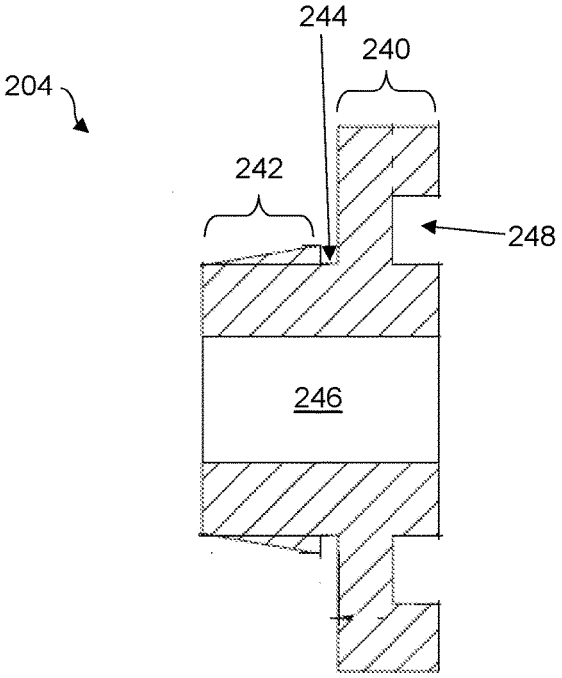
FIG. 5C is a cross sectional view of the grommet of the clip of FIG. 3A.

Referring to FIGS. 5A, 5B, and 5C, an exemplary grommet is shown at 204. The grommet 204 includes a joist contact portion 240, an insert contact portion 242, an opening contact portion 244, and defines an insert cavity 246. The joist contact portion 240 is substantially cylindrical. When the clip 200 (FIGS. 3A and 3B) is assembled, the joist contact portion 240 is located on a side of the clip 200 and opposite the channel interface 212 such that a side of the joist contact portion 240 facing the insert contact portion 242 contacts the clip 200. When installed in the floor assembly 100, the joist contact portion 240 contacts the joist 102 (FIG. 1). The joist contact portion 240, and the grommet 204 as a whole, physically decouple the body 202 (FIGS. 4A and 4B) of the clip 200 and the support channel 106 (FIG. 1) from the joist 102 by providing damping, resulting in reduced vibration. The joist contact portion 240 may have a diameter in the range of about 25 mm to about 75 mm, or in another example, in the range of about 25 mm to about 50 mm, or in another example, in the range of about 35 mm to about 45 mm. In a preferred embodiment, the joist contact portion may have a diameter of about 38 mm.

The side of the joist contact portion 240 facing away from the insert contact portion 242 includes an annular groove 248. The annular groove 248 may limit connection from the grommet 204 to the clip 200. The groove 248 may have an inner diameter in the range of about 5 mm to about 35 mm, or in another example, in the range of about 10 mm to about 30 mm, or in another example, in the range of about 15 mm to about 25 mm. In a preferred embodiment, the groove 240 has an internal diameter of about 19 mm. The groove 248 may have an outer diameter in the range of about 10 mm to about 40 mm, or in another example, in the range of about 15 mm to about 35 mm, or in another example, in the range of about 20 mm to about 35 mm, or in another example, in the range of about 25 mm to about 35 mm. In a preferred embodiment, the groove 248 has an outer diameter of about 29 mm.

The insert contact portion 242 is substantially cylindrical and, as illustrated, may have a truncated cone shape, which facilitates installation of the grommet 204 onto the clip 200 (FIGS. 3A and 3B). When the clip 200 is assembled, the insert contact portion 242 is located on the same side of the clip 200 as the channel interface 216 and a side of the insert contact portion 242 facing the joist contact portion 240 contact the clip 200. The insert contact portion 202 provides a surface along which a portion of the insert 206 rests. The insert contact portion 242 may have a uniform diameter. The insert contact portion 242 may have a diameter in the range of about 10 mm to about 35 mm, or in another example, in the range of about 15 mm to about 30 mm, or in another example, in the range of about 15 mm to about 25 mm. In an embodiment where the insert contact portion 242 has a truncated cone shape, the diameter of the insert contact portion 242 will increase from a side of the insert contact portion 242 facing away from the joist contact portion 240 to a side of the insert contact portion 242 facing the joist contact portion 240. The side of the insert contact portion 242 facing away from the joist contact portion 240 may have a diameter in the range of about 10 mm to about 35 mm, or in another example, in the range of about 15 mm to about 30 mm, or in another example, in the range of about 15 mm to about 25 mm. In a preferred embodiment, the side of the insert contact portion 242 facing away from the joist contact portion 240 has a diameter in of about 19 mm. The side of the insert contact portion 242 facing the joist contact portion 240 may have diameter in the range of about 10 mm to about 35 mm, or in another example, in the range of about 15 mm to about 30 mm, or in another example, in the range of about 15 mm to about 25 mm. In a preferred embodiment, the side of the insert contact portion 242 facing the joist contact portion 240 has a diameter of about 22 mm.

The opening contact portion 244 is located between and connects the joist contact portion 240 and the insert contact portion 242. The opening contact portion 244 is substantially cylindrical. When the clip 200 (FIGS. 3A and 3B) is assembled, the opening contact portion 244 is located in the opening 218. The opening contact portion 244 may have a diameter in the range of about 10 mm to about 30 mm, or in another example, in the range of about 15 mm to about 25 mm. In a preferred embodiment, the opening contact portion 244 has a diameter in the range of about 19 mm.

The insert cavity 246 is a centrally located, generally cylindrical cavity (a through-hole) that extends through the insert contact portion 242, the opening contact portion 244, and the joist contact portion 240. The insert cavity 246 provides a feature that receives a portion of the insert 206 (FIGS. 3A and 3B) and receives a structural member fastener that attaches the clip 200 (FIGS. 3A and 3B) to the joist 102 (FIG. 1). The insert cavity 246 may have a diameter in the range of about 1 mm to 15 mm, or in another example, in the range of about 5 mm to about 10 mm. In a preferred embodiment, the insert cavity 246 has a diameter of about 9 mm.

The grommet 204 made be made from a material, usually rubber, that is suitable for the aims of the present disclosure. The grommet 204 may be made from styrene butadiene rubber, styrenic block copolymer, ethylene-propylene diene monomer, isobutylene-isoprene rubber, isoprene rubber, acrylonitrile-butadiene rubber, chloroprene rubber, silicone, thermoplastic olefin, or a mixture of two or more thereof. The grommet 204 may be made from a soft polymer, a foamed polymer, or a mixture of two or more thereof. It is to be appreciated that any suitable material may be employed in the construction of the grommet 204, such as polymeric material, a polymeric material featuring a flame-resistant additive, and the like.

Figure 6A:
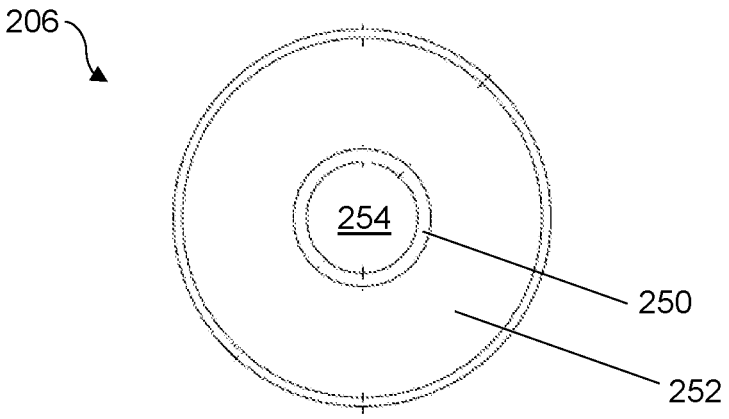
FIG. 6A is a top view of the insert of the clip of FIG. 3A.
Figure 6B:
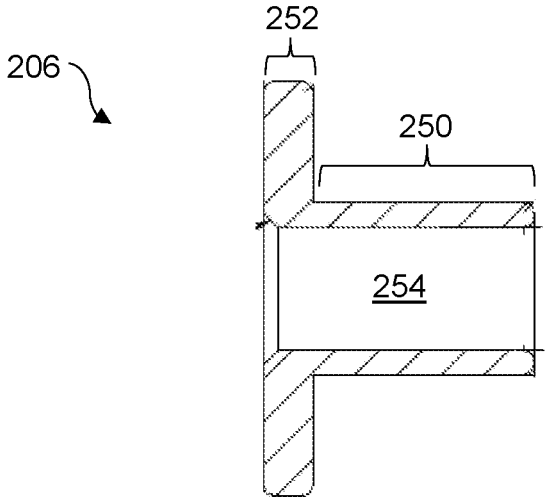
FIG. 6B is a cross sectional view of the insert of the clip of FIG. 3A.

Referring to FIGS. 6A and 6B, an exemplary insert is shown at 206. The insert 206 includes a cylindrical portion 250, a disk portion 252, and defines a fastener cavity 254.

The insert 206 provides a feature into which a structural member fastener is received to secure the clip 200 (FIGS. 3A and 3B) to the joist 102 (FIG. 1). The cylindrical portion 250 is substantially cylindrical and extends away from the disk portion 252. When the clip 200 is assembled, the insert 206 is inserted into the grommet 204 such that the cylindrical portion is inside the insert cavity 242 and contacting the insert contact portion 242 of the grommet 242. The cylindrical portion 250 may have a length in the range of about 5 mm to about 20 mm, or in another example, in the range of about 10 mm to about 15 mm. In a preferred embodiment, the cylindrical portion 250 has a length of about 11 mm. The cylindrical portion may have a diameter in the range of about 1 mm to about 15 mm, or in another example, in the range of about 5 mm to about 10 mm. In a preferred embodiment, the cylindrical portion 250 has a diameter in the range of about 9 mm.

The disk portion 252 is substantially cylindrical. When the clip 200 (FIGS. 3A and 3B) is assembled, a side of the disk portion 252 facing the cylindrical portion 250 contacts the insert contacting portion 242 of the grommet 204. The disk portion 252 may have a diameter in the range of about 10 mm to about 30 mm, or in another example, in the range of about 15 mm to about 25 mm, or in another example, in the range of about 20 mm to about 25 mm. In a preferred embodiment, the disk portion 252 has a a diameter of about 21 mm. The disk portion 252 may have a length in the range of about 1 mm to about 5 mm, or in another example, in the range of about 2 mm to about 4 mm. In a preferred embodiment, the disk portion 252 has a a length of about 3 mm.

The fastener cavity 254 is a centrally located, generally cylindrical cavity that extends through the disk portion 252 and cylindrical portion 250. The fastener cavity 250 provides a feature that receives a structural member fastener that attaches the clip 200 (FIGS. 3A and 3B) to the joist 102 (FIG. 1).

The insert 206 may be made of a material, usually metal, that is suitable for the aims of the present disclosure. For example, the insert 206 made be made from carbon steel, alloy steel, stainless steel, tool steel, or a mixture of two or more thereof. However, any suitable material may be employed in the construction of the insert 206, such as a polymeric material, a polymeric material featuring a flame-resistant additive, a suitable metal, reinforced ceramic and the like.

Figure 7:
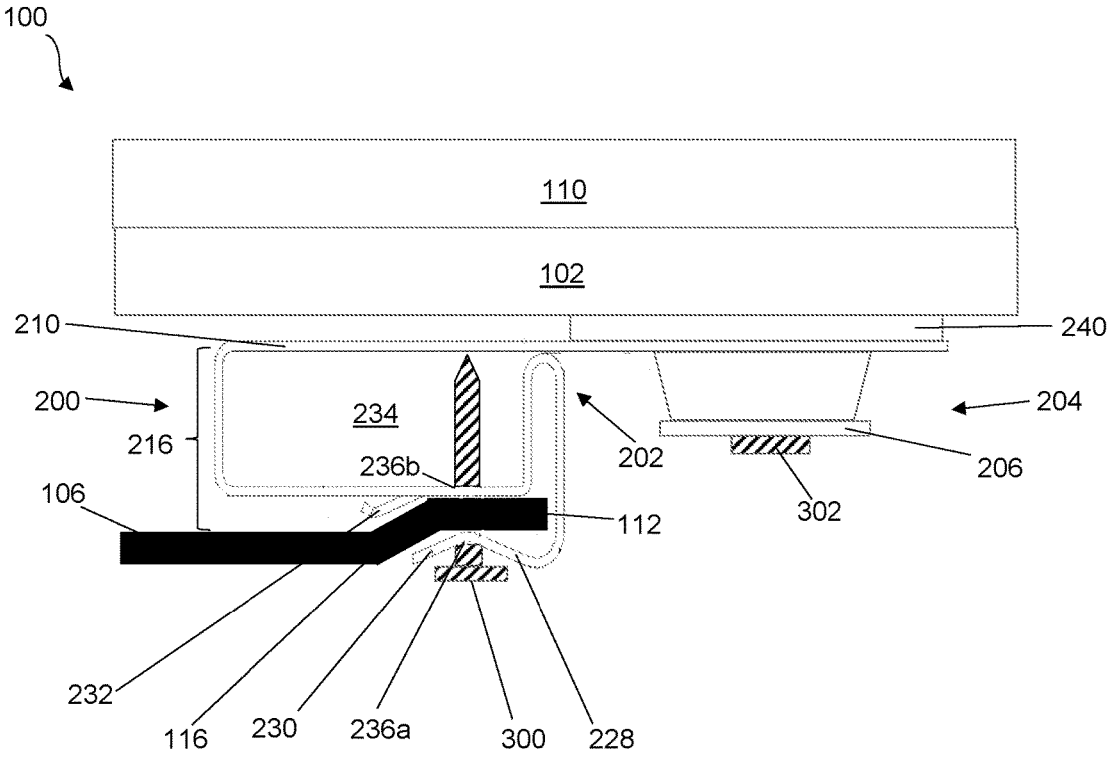
FIG. 7 is a cross sectional view of portions of the building assembly of FIG. 1 particularly illustrating the fastening of the clip to respective flooring assembly components.

Referring to FIG. 7, an exemplary flooring system including a clip 200 is shown at 100. The base 210 of the clip 200 avoids a short circuit by providing a barrier between the joist 102 and support channel 106 that is impervious to a channel fastener and thereby prevents a channel fastener from extending into the joist 102. The grommet 204 of the clip 200 physically decouples the body 202 of the clip 200 and the support channel 106 from the joist 102, resulting in reduced vibration and isolation damping. The slots 236*a* and 236*b* of the clip 200 provide a feature that receives a channel fastener to secure the support channel 106 to the clip 200, which is stronger than securing the support channel 106 to the clip 200 by friction alone. Additionally, the slots 236*a* and 236*b* may allow for the clip 200 to expand during high heating situations (e.g., building fire) and extend the time period before a potential catastrophic failure.

In an exemplary installation, the joists 102 are installed and then a clip 200 and a support channel 106 are joined into an assembly. To accomplish this, the flange 112 of the support channel 106 is inserted into the channel interface 216 of the clip 200. Specifically, the lip 228 and flare 230 of the clip 200 underlie the flange 112 of the channel and facilitate the insertion of the flange 112 of the support channel 106 into the channel interface 216. The projection 232 applies pressure to the angular arm 116 of the support channel 106, thereby decreasing the likelihood that the support channel 106 may inadvertently come dissociated from the clip 200. A channel fastener 300 is driven through the first slot 236*a*, through the flange 112 of the support channel 106, through the second slot 236*b*, and into the cavity 234 of the clip 200. The channel fastener 300 extending through the slots 236*a* and 236*b* secures the support channel 106 to the clip 200. The channel fastener 300 is prevented from extending through the joist 102 by the base 210 of the clip 200.

The joined clip 200 and support channel 106 are brought to the joist 102 and fastened thereto. Specifically, the joist contact portion 240 of the grommet 204 of the clip 200 is positioned against the joist 102 such that the channel interface 216 of the clip 200 is facing away from the joist 102 and the support channel 106 is disposed below the clip 200. A structural member fastener 302 is inserted through the fastener cavity 254 of the insert 206 and the insert cavity 246 of the grommet 204 into the joist 102. With this positioning, the grommet 204 physically decouples the body 202 of the clip 200 and the support channel 106 from the joist 102, resulting in reduced vibration and isolation dampening.

The fasteners 300 and 302 may be any of a variety of suitable threaded or non-threaded fasteners, such as nails, screws, bolts, etc.

Figure 8:
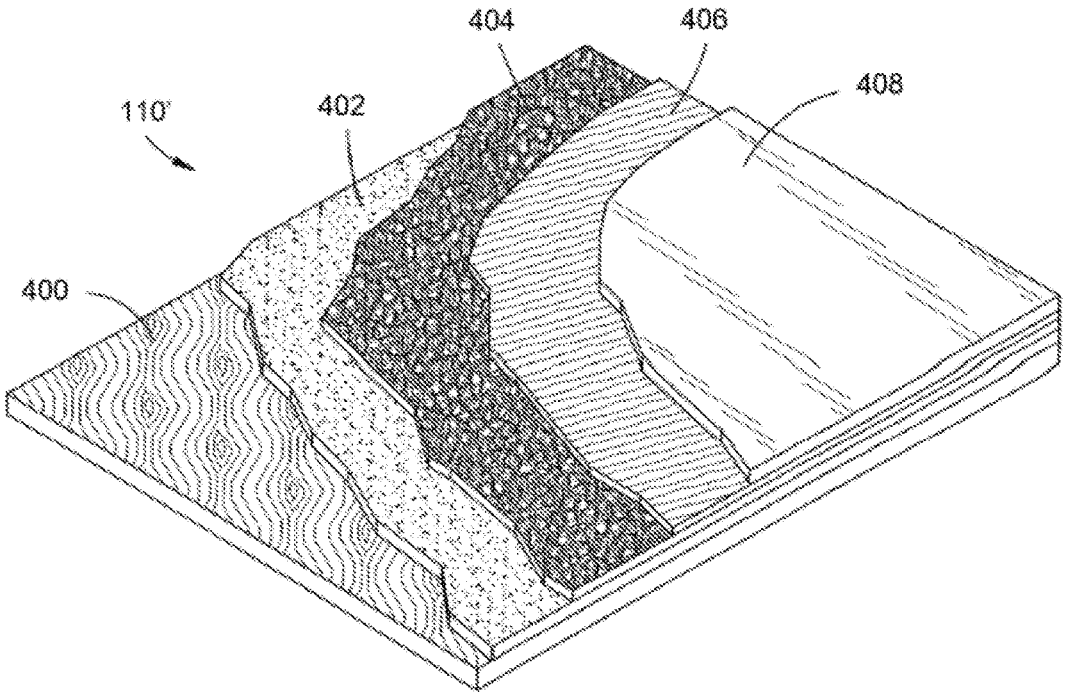
FIG. 8 is a perspective view of an exemplary flooring element that may be included in the building assembly of FIG. 7.

As shown in FIG. 7, the joist 102 provides a substrate onto which finished flooring element 110 is installed. Referring to FIG. 8, an exemplary flooring element is shown at 110'. The solid base 400 overlies the joist 102. The base is illustrated as being a layer of wood, although it may take other forms, such as a layer of concrete. A compressible layer 402 may overlie at least a portion of the base 400. A mat layer 404, which takes the form of an open network of entangled fibers, overlies at least a portion of the compressible layer 402, and creates a void space underlying the substrate layer 408. A porous separation layer 406 overlies at least a portion of the mat layer 404. This porous separation layer 406 serves to carry a floating, solid substrate layer thereupon. The substrate layer 408 provides loading for causing the compressible layer 402 to compress into the overlying entangled mat layer 404.

The optional compressible layer 402 may be manufactured from an ultra lightweight fabric that is "cotton" like in nature. The "cotton" fabric is engineered to compress into the bottom side of the entangled mat 404 creating a small cushion under the filaments and pressing back toward the floating substrate 408. The "cotton" fabric 402 is typically made from a polymer based filament in a manufacturing process known as carding. In carding, chopped filaments are combed in one direction and then heated and needled to make them combine into a monolithic mat. Needling is the driving and removing of sharp, thin metal (needles) through the filaments to entangle them together. This carding/heating/needling process allows for the material to achieve a designation as a high loft or thick fabric quality. With the thick product, a 100 gram per square meter material can be from about 0.125 inch thick to about 0.626 inch thick, depending on density. Many other products that are carded/heated/needled are engineered to be dense and flat. Consequently, this fabric is highly compressible and can be engineered to almost completely compress under a typical load, such as the load of a floating substrate.

The mat layer 404 is a void creating layer that includes a plurality of intertwined filaments that twist and turn about at random and are bonded at random into sections or contact zones as by heat bonding or other suitable bonding or connection technique. These filaments may be of any suitable, strong and mildew-resistant polymeric material. In one embodiment, the filaments are formed in a desired thickness on the order of about 0.125 inch to about 0.75 inch to provide the desired breathability and venting capability for water vapor, air, and other gaseous substances. The monofilaments may have an average diameter in the range of about 1 mils to about 4 mils, and in another example, in the range of about 2 mils to about 3 mils.

The entangled mat may be constructed in accordance with techniques well known to one of ordinary skill in the art, such as disclosed by, for example, U.S. Pat. Nos. 3,687,759; 3,691,004; and 4,212,692, the contents of all of which are hereby incorporated by reference in their entireties.

The filaments of mat 404 may be made from any thermoplastic polymer that provides the desired properties of strength and resilience for the application in which it is used. For example, the monofilaments may be made of a polyolefin (e.g., polyethylene, polypropylene, etc.), polyamide (e.g., Nylon), polyester, polyvinyhalide (e.g., polyvinylchloride (PVC), polyvinylidene chloride, polyvinyltetrafluoride, polyvinyl chlorotrifluoride), polystyrene, polyvinylester (e.g., polyvinyl acetate, etc.) or a mixture of two or more thereof.

The porous separation layer 406 that overlies a portion of the entangled net layer 404 is constructed of a material that is air and water pervious. The porous separation layer 406 is preferably a non-woven film-like material. It enables a hardenable, cement-type material to be poured over top of the mat layer 404 to harder or cure in place to form substrate layer 408. This substrate layer 408, which overlies at least a portion of the separation layer 406, is a floating solid substrate, and is preferably a gypsum cement layer. The porous separation layer 406 prevents fine particles of the overlying substrate layer 408 from passing into the void space creating layer 16. The substrate layer 408 may include wood, tile, or carpet.

The porous separation layer 406 may include natural fibers, synthetic fibers or a mixture thereof. The fibers may be chopped fibers or continuous fibers. As used herein, the term "continuous fiber" means a fiber having a fiber length preferably of 70 mm or longer, or 80 mm or longer, or 100 mm or longer. The term "chopped fiber" as used herein means fiber having a fiber length of less than 70 mm, or 5 to 70 mm, or 10 to 50 mm.

The separation layer 406 may be constructed a nonwoven fabric made of polyolefin fibers such as polyethylene and polypropylene; polyester fibers such as polyethylene terephthalate (PET), polytrimethylene terephthalate, and polyethylene naphthalate; polyamide fibers such as nylon; rayon fibers and other synthetic fibers. The nonwoven fabrics may be nonwoven fabrics made of single fibers or nonwoven fabrics made of two or more kinds of fibers used in combination.

The porous separation layer 406 may be enhanced with one or more compounds that help absorb moisture. In one embodiment, the porous separation layer includes an absorbent polymer held within the fibers or applied to the surface of the separation layer. Examples of absorbent polymers include, for example, sodium polyacrylate, acrylic acid-vinyl alcohol copolymers, crosslinked sodium polyacrylate, starch-acrylic acid graft polymers, isobutylenemaleic anhydride copolymers and saponification products thereof, potassium polyacrylate, and cesium polyacrylate. In one embodiment, the absorbent polymer preferably has the capability of absorbing at least 20 times its weight in water.

The porous separation layer 406 may also be sprayed with a nano-technology solution that helps promote drying by bonding to the water molecules in the substrate layer.

The separation layer 406 may be constructed of multiple layers. In one embodiment, the separation layer has an upper water-transmissive layer integral with a lower water-transmissive layer. In another embodiment, the separation layer may include an intermediate layer positioned between an upper water-transmissive layer and a lower water- or vapor-transmissive layer, the intermediate layer including a moisture absorbing composition.

The present disclosure provides a clip 200 for securing a support channel 106 in an acoustical ceiling mount and a building construction having a flooring or ceiling assembly 100 that displays improved acoustic characteristics. The clip 200 includes a body 202 having a penetration-resistant base 210, a channel interface 216 extending outwardly from a portion 214 of the base 210 configured to engage the support channel, and an opening 218 in another portion 212 of the base 210, a grommet 204 engaged in the opening 218 of the body 202, and an insert 206 engaged in the grommet 204. The channel interface 216 includes at least a first slot **236*a* configured to receive a channel fastener 300 to secure the support channel 106 to the clip 200. The clip 200 may be operatively coupled with a support channel 106 and disposed in a building construction between the support channel 106 and a finished interior element 104**.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A clip for securing a support channel in an acoustical wall or ceiling mount, the clip comprising:

a body having a penetration-resistant base, a channel interface extending outwardly from a portion of the base and configured to engage the support channel, and an opening in another portion of the base, the channel interface including a support channel receiving lip, the support channel receiving lip including a first slot configured to receive a channel fastener to secure the support channel to the clip;

a grommet engaged in the opening of the body; and an insert engaged in the grommet.

2. The clip of claim 1, wherein the support channel receiving lip has a J-shaped configuration, a planar portion of the support channel receiving lip extending orthogonally away from the base, and a curved portion of the support channel receiving lip extending back toward the base.

3. The clip of claim 2, wherein the channel interface includes a flare extending away from the support channel receiving lip and away from the base such that the support channel receiving lip and flare are configured to underlie the support channel disposed in the channel interface.

4. The clip of claim 3, wherein the channel interface includes a projection extending away from the base along a plane parallel to the flare and configured to apply pressure to the support channel.

5. The clip of claim 3, wherein the channel interface includes a first leg extending orthogonally away from the base opposite the support channel receiving lip, an engaging portion extending orthogonally away from the first leg toward the support channel receiving lip along a plane parallel to the base, and a second leg extending orthogonally away from the engaging portion towards the base along a plane parallel to the first leg.

6. The clip of claim 5, wherein the engaging portion includes a projection extending away from the engaging portion in a direction opposite the base along a plane parallel to the flare and configured to apply pressure to the support channel.

7. The clip of claim 5, wherein the channel interface includes the first slot defined by an opening through the support channel receiving lip and flare and further includes a second slot defined by an opening through the engaging portion, the first and second slots being configured to receive the channel fastener to secure the support channel between the support channel receiving lip and flare and engaging portion.

8. The clip of claim 7, wherein a cavity is defined by the base, the first leg, the engaging portion, and the second leg; wherein the channel fastener received by the first and second slots continues into the cavity; and wherein the base is configured to prevent the channel fastener from penetrating therethrough.

9. The clip of claim 1, wherein the grommet includes a joist contact portion on a side of the base opposite the channel interface configured to physically decouple the clip and the support channel from an adjacent joist.

10. The clip of claim 1, wherein the grommet and insert are configured to receive a structural member fastener to secure the clip to an adjacent joist.

* * * * *